US007912398B2

(12) United States Patent
Yoo

(10) Patent No.: US 7,912,398 B2
(45) Date of Patent: Mar. 22, 2011

(54) IMAGE FORMING APPARATUS CLEANING DEVICE ACTUATED BY DOOR OR PAPER FEEDING CASSETTE

(75) Inventor: Byoung Ho Yoo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 408 days.

(21) Appl. No.: 12/107,852

(22) Filed: Apr. 23, 2008

(65) Prior Publication Data

US 2009/0041497 A1 Feb. 12, 2009

(30) Foreign Application Priority Data

Aug. 9, 2007 (KR) ..... 10-2007-0080001

(51) Int. Cl.
*G03G 21/00* (2006.01)

(52) U.S. Cl. ..... 399/98

(58) Field of Classification Search ..... 399/98
See application file for complete search history.

(56) References Cited

U.S. PATENT DOCUMENTS 6,029,028 A * 2/2000 Inoue ..... 399/92
2006/0115303 A1* 6/2006 Kang et al. ..... 399/301

FOREIGN PATENT DOCUMENTS

JP 2004-341042 12/2004
KR 10-0547137 1/2006

OTHER PUBLICATIONS

English Abstract for Korean Patent Publication No. 2005-20379.

* cited by examiner

*Primary Examiner* — David M Gray
*Assistant Examiner* — G. M. Hyder
(74) *Attorney, Agent, or Firm* — Staas & Halsey LLP

(57) ABSTRACT

An image forming apparatus and a cleaning device capable of conveniently cleaning inner components without an additional driving source. The image forming apparatus includes a main body having a main body frame and a moving part provided movably relative to the main body frame, and a compressed air supply unit to compress air by interlocking with movement of the moving part and supply the compressed air to a laser scanning device to clean the laser scanning device. The moving part may be a cover hingedly coupled to the main body frame to open and shield a portion of the main body, or a paper feeding cassette removably mounted to the main body frame. The compressed air supply unit includes a cylinder coupled to the main body frame, and a piston coupled to the moving part.

24 Claims, 8 Drawing Sheets

IMAGE FORMING APPARATUS CLEANING DEVICE ACTUATED BY DOOR OR PAPER FEEDING CASSETTE

CROSS-REFERENCE TO RELATED APPLICATION

This application claims the benefit of Korean Patent Application No. 2007-80001, filed in the Korean Intellectual Property Office on Aug. 9, 2007, the disclosure of which is incorporated herein by reference.

BACKGROUND OF THE INVENTION

1. Field of the Invention

Aspects of the present invention relate to an image forming apparatus, and more particularly, to an image forming apparatus having a cleaning device to remove foreign substances attached to inner components.

2. Description of the Related Art

An image forming apparatus is an apparatus that prints an image onto a printable medium, such as paper, according to an inputted image signal. An electrophotographic type image forming apparatus is configured such that light is scanned to a photosensitive body charged with a predetermined electric potential so as to form an electrostatic latent image on an outer surface of the photosensitive body. The electrostatic latent image is developed into a toner image by supplying a toner to the electrostatic latent image, and the toner image is transferred and fused onto a printable medium.

An electrophotographic image forming apparatus generally includes a laser scanning device to form an electrostatic latent image on a photosensitive body. The laser scanning device includes a housing with a light transmitting member. Optical components, such as a light source, an optical deflector, an f-theta (fθ) lens, a mirror, and the like, are mounted inside the housing. The light emitted from the light source is deflected in a main scanning direction by the optical deflector, and is guided toward the light transmitting member mounted to the housing via the f-theta lens and the mirror. The light is scanned outside the housing through the light transmitting member.

If foreign substances in the image forming apparatus, such as paper dust or toner, are attached to the light transmitting member of the laser scanning device, the foreign substances partially interrupt the light scanned to the photosensitive body from the laser scanning device and disturb the formation of the electrostatic latent image, which causes deterioration of print quality.

To cope with this problem, Japanese Patent Laid-Open Publication No. 2004-341042 ("reference 1") discloses a cleaning device of a laser scanning device to clean a light transmitting member (dustproof glass) by spraying compressed air supplied from an external source into the light transmitting member. Korean Patent Registration No. 0547137, published as KR 2005-20379 ("reference 2") discloses a cleaning device of a laser scanning device to remove foreign substances attached to an outer surface of a light transmitting member by blowing air through a blower fan. However, the cleaning device disclosed in reference 1 is not practical because a user needs to perform a connecting work with a compressed air supply source provided separately whenever cleaning the light transmitting member. Further, the disclosed cleaning device gives a user inconvenience of participating in the cleaning work for the light transmitting member each time.

The cleaning device disclosed in reference 2 has an advantage of conveniently cleaning the light transmitting member using a blower fan. However, an additional driving source to drive the blower fan increases component costs. Further, when a space around the laser scanning device is small, there is a limitation in mounting the blower fan near the light transmitting member.

SUMMARY OF THE INVENTION

Aspects of the present invention provide an image forming apparatus and a cleaning device thereof that is capable of conveniently cleaning inner components without an additional driving source.

According to an aspect of the invention, an image forming apparatus to form an image onto a printable medium is provided. The image forming apparatus comprises a main body having a main body frame and a moving part provided movably relative to the main body frame; a laser scanning device; and a compressed air supply unit to compress air by interlocking with movement of the moving part and to supply the compressed air to the laser scanning device so as to clean the laser scanning device.

According to another aspect of the present invention, the moving part includes a cover hingedly coupled to the main body frame so as to selectively allow access to the interior of the image forming apparatus. The compressed air supply unit may be mounted adjacent to a rotational center of the cover and the laser scanning device.

According to another aspect of the present invention, the moving part includes a paper feeding cassette removably mounted to the main body frame.

According to another aspect of the present invention, the compressed air supply unit includes a cylinder coupled to the main body frame and a piston coupled to the moving part.

According to another aspect of the present invention, the image forming apparatus further comprises at least one connecting pipe to guide the compressed air in the compressed air supply unit to the laser scanning device. The connecting pipe may be made of a flexible material.

According to another aspect of the present invention, the laser scanning device include a light transmitting member; and the image forming apparatus further comprises a spray member mounted near the light transmitting member. The spray member may have a spray hole to spray the compressed air supplied from the compressed air supply unit to the light transmitting member.

According to another aspect of the present invention, the image forming apparatus further comprises a valve member mounted to the spray member to open and close the spray hole.

According to another aspect of the invention, an image forming apparatus is provided. The image forming apparatus comprises a main body having a main body frame and a cover hingedly coupled to the main body frame; a cylinder including an air compression unit; a piston having a first end to move in the air compression unit in a reciprocating fashion so as to compress air, and a second end portion coupled to the cover; an object to be cleaned by the air compressed in the cylinder; and at least one connecting pipe to guide the compressed air to the object to be cleaned.

According to another aspect of the present invention, the image forming apparatus further comprises a photosensitive body, and a laser scanning device having a housing provided with a light transmitting member. The laser scanning device scans light to the photosensitive body through the light transmitting member to form an electrostatic latent image onto the photosensitive body. The object to be cleaned includes the light transmitting member.

According to another aspect of the present invention, the piston compresses the air by moving along a rotational trajectory of the cover.

According to another aspect of the present invention, the piston includes a piston rod having an arc shape, and the air compression part has an arc shape corresponding to the shape of the piston rod.

According to another aspect of the invention, an image forming apparatus is provided. The image forming apparatus comprises a main body frame; a paper feeding cassette removably mounted to the main body frame; a cylinder fixed to the main body frame; a piston having a first end to move in the cylinder in a reciprocating fashion so as to compress air, and a second end connected to the paper feeding cassette; an object to be cleaned by the air compressed in the cylinder; and at least one connecting pipe to guide the compressed air to the object to be cleaned.

According to another aspect of the invention, a cleaning device to clean a component mounted in an image forming apparatus is provided. The cleaning device comprises a compressed air supply unit having a cylinder and a piston to move in the cylinder in a reciprocating fashion so as to compress air; and at least one connecting pipe having a first end communicating with the cylinder, and a second end extending toward the component to be cleaned. The connecting pipe may be made of a flexible material.

According to another aspect of the present invention, the compressed air supplied from the compressed air supply unit is sprayed to a light transmitting member provided in a laser scanning device of the image forming apparatus.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE EMBODIMENTS

Figure 1:
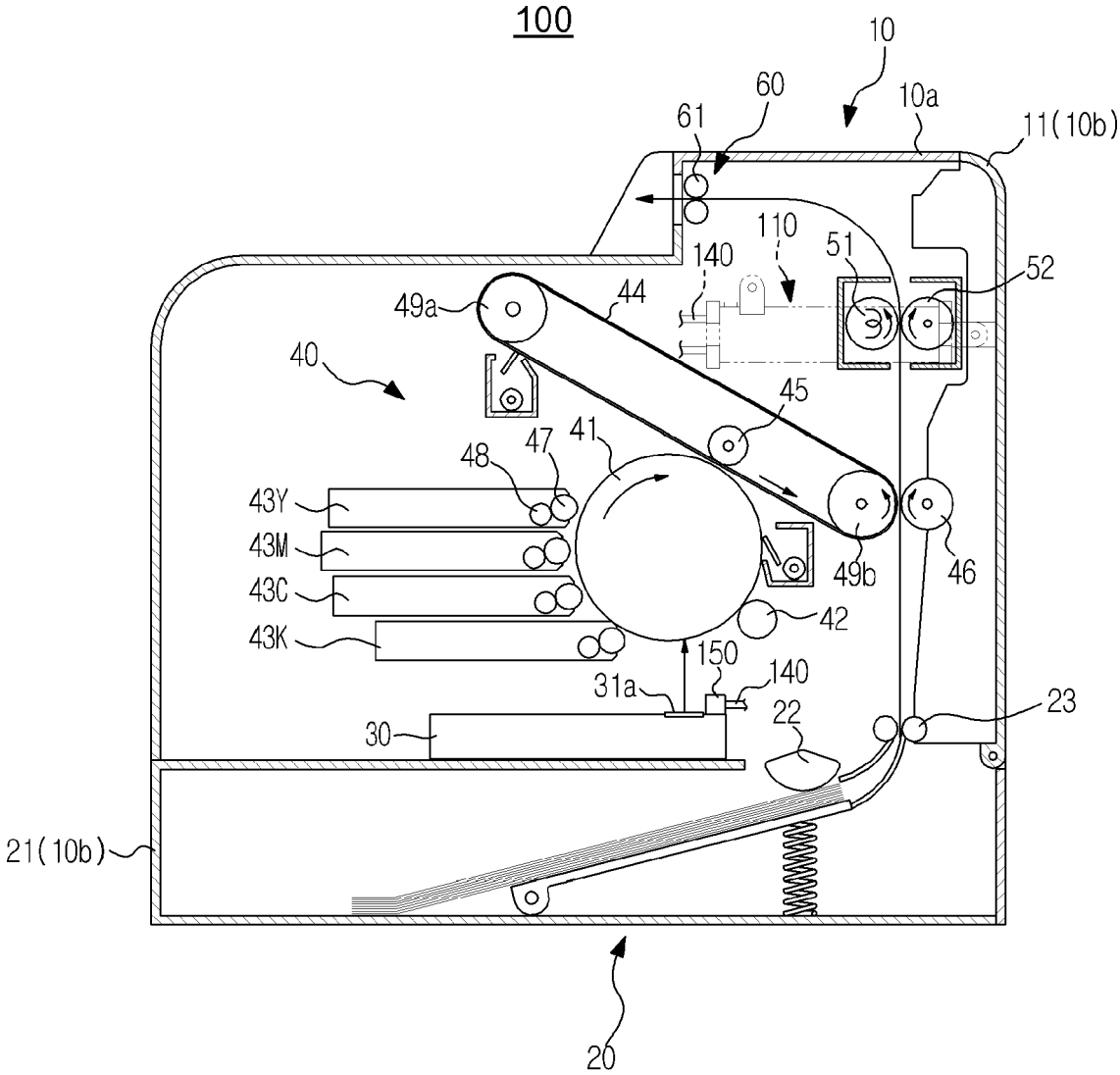
FIG. 1 is a view illustrating a constitution of an image forming apparatus according to an embodiment of the present invention.

Reference will now be made in detail to present embodiments of the present invention, examples of which are illustrated in the accompanying drawings, wherein like reference numerals refer to like elements throughout. The embodiments are described below in order to explain the present invention by referring to the figures.

Figure 2:
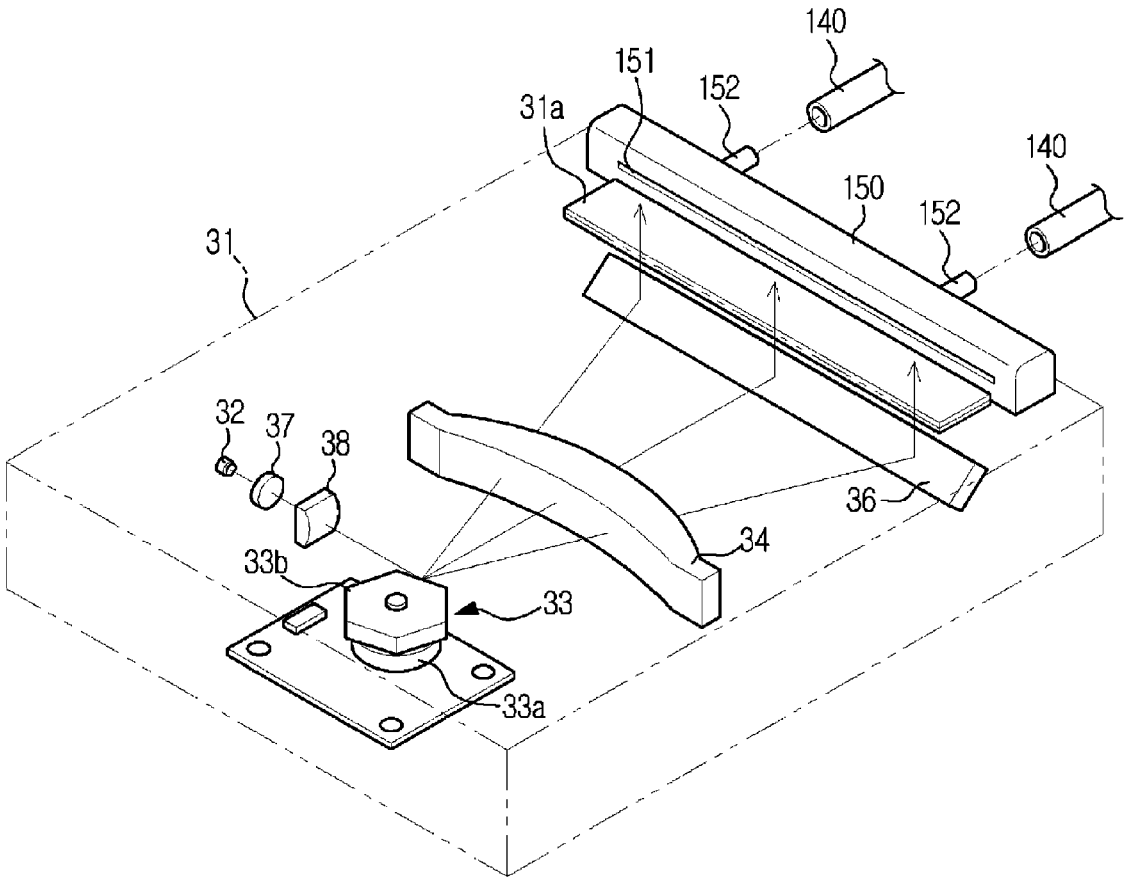
FIG. 2 is a perspective view illustrating a laser scanning device and a spray member in the image forming apparatus according to an embodiment of the present invention.
Figure 3:
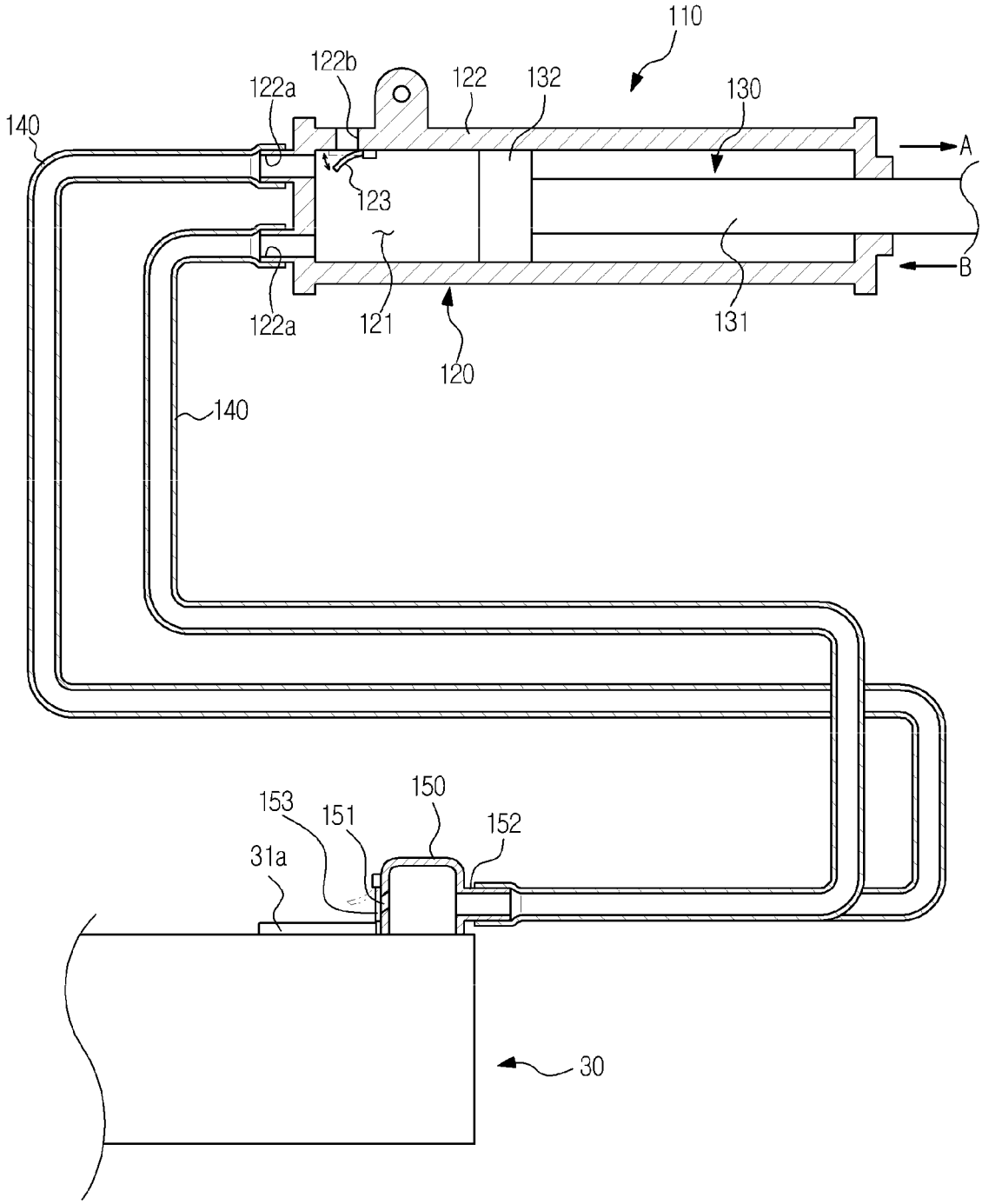
FIG. 3 is a sectional view illustrating a constitution of a cleaning device in the image forming apparatus according to an embodiment of the present invention.
Figure 4:
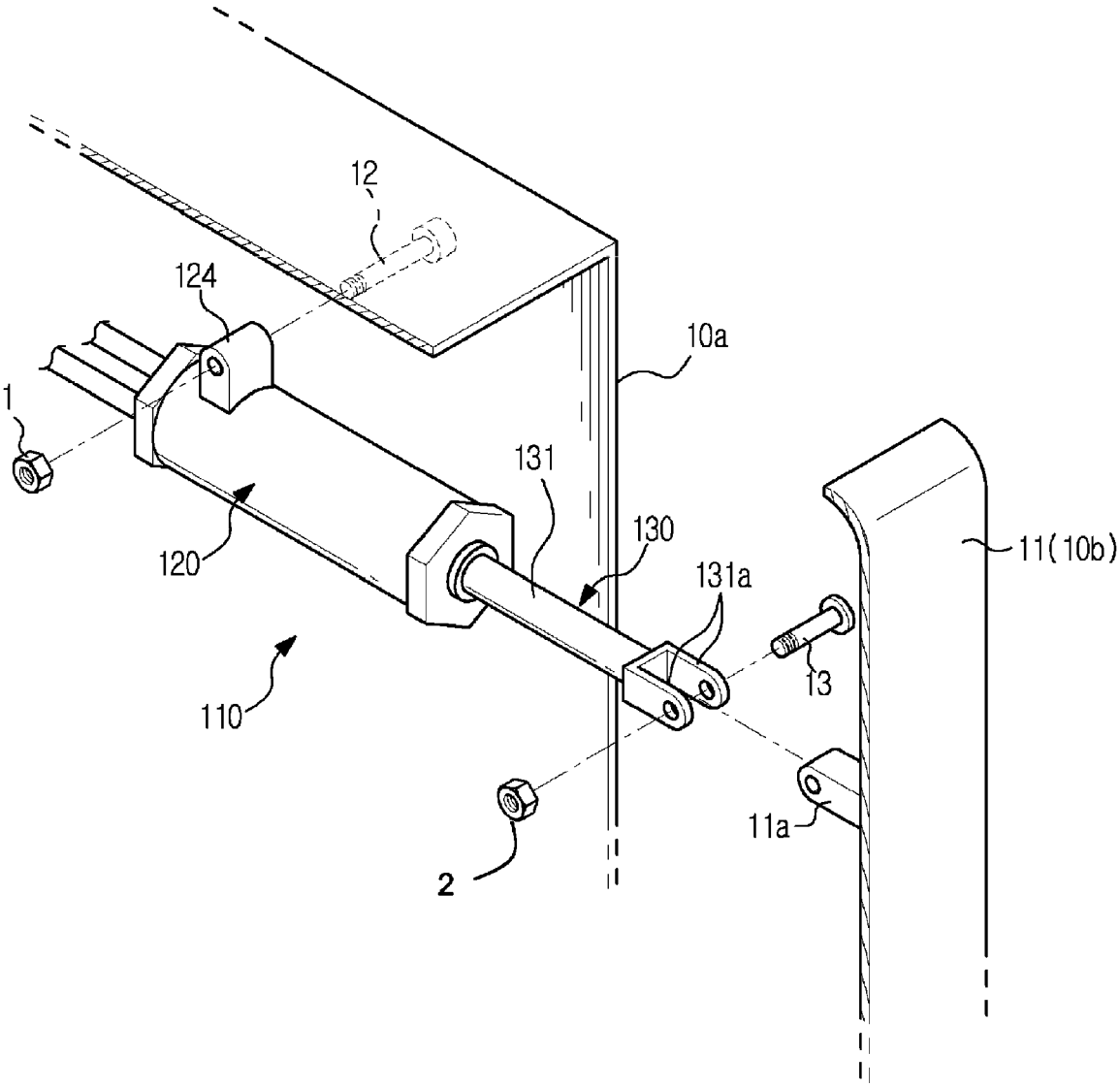
FIG. 4 is a perspective view illustrating a mounting structure of a compressed air supply unit in the image forming apparatus according to an embodiment of the present invention.

FIG. 1 shows an image forming apparatus 100 according to an embodiment of the present invention, and FIG. 2 shows a laser scanning device and a spray member according to an embodiment of the present invention. FIG. 3 shows a cleaning device according to an embodiment of the present invention, and FIG. 4 shows a mounting structure of a compressed air supply unit according to an embodiment of the present invention.

As shown in FIG. 1, the image forming apparatus 100 according to an embodiment of the present invention includes a main body 10, a paper feeding device 20, a laser scanning device 30, a developing device 40, a fusing device 50, and a paper discharge device 50. According to other aspects of the present invention, the image forming apparatus 100 may have additional and/or different components; for example, an inkjet type image forming apparatus may not include a fuser or a laser scanning device. Similarly, the functionality of two or more of the above units may be combined into a single component. The image forming apparatus 100 may also be included in a multifunction device including copy, a scan, and/or facsimile functions in addition to the printing function.

The paper feeding device 20 supplies a printable medium, such as a paper S. The laser scanning device 30 scans light corresponding to image information onto a photosensitive body. The developing device 40 develops an image on the printable medium using the image scanned onto the photosensitive body. The fusing device 50 fuses the image to the printable medium by applying heat and pressure to the printable medium, and the paper discharge device 60 discharges the printable medium having the image to the exterior of the main body 10.

The main body 10 includes a main body frame 10*a* to house and support components of the image forming apparatus 100 and a moving part 10*b* provided movably relative to the main body frame 10*a*. The moving part 10*b* may be a cover 11 hingedly coupled to the main body frame 10*a* to allow access to the interior of the image forming apparatus 100. A user can access the interior of the main body 10 by opening the cover 11, and can repair or replace the components arranged within or remove jammed paper. The moving part 10*b* may also be a paper feeding cassette 21 that can be mounted and removed while moving relative to the main body frame 10*a*. The paper feeding cassette 21 may be a component of the paper feeding device 20. The paper feeding cassette 21 may also be considered as a part of the main body 10 in the respect of forming a portion of an exterior appearance.

The paper feeding device 20 includes the aforesaid paper feeding cassette 21 to receive the paper S, a pickup roller 22, and a feeding roller 23. The pickup roller 22 picks up the paper S in the paper feeding cassette 21 sheet by sheet, and the feeding roller 23 feeds the picked-up paper S toward the developing device 40. The paper feeding cassette 21 is removably coupled to the main body frame 10*a* so as to allow the user to remove the paper feeding cassette 21 and insert additional printable media. However, the cassette need not be used in all aspects, such as where the paper feeding device 20 is a tray holding printable media.

As shown in FIGS. 1 and 2, the laser scanning device 30 includes a housing 31 having a light transmitting member 31*a* so that light can be irradiated to the outside, and a scanning optical system mounted in the housing 31. The scanning optical system includes a light source 32 to emit light according to an image signal, an optical deflector 33, an f-theta (fθ) lens 34, and a mirror 36. The optical deflector deflects the light emitted from the light source 32 so as to be scanned to a photosensitive body 41 of the developing device 40. The f-theta (fθ) lens 34 corrects aberration included in the light deflected from the optical deflector 33, and the mirror 36 reflects the light passing through the f-theta lens 34 toward the photosensitive body 41. The optical deflector 33 includes a driving source 33*a*, and a polygon mirror 33*b* rotating by the driving source 33*a*. The polygon mirror 33*b* has plural reflecting surfaces at a side portion to deflection-scan the light incident from the light source 32 while being rotated by the driving source 33*a*. A collimating lens 37 and a cylindrical lens 38 are mounted in an optical path between the light source 32 and the optical deflector 33. The collimating lens 37 condenses the divergent light emitted from the light source 32 into parallel light or convergent light, and the cylindrical lens 38 converts the light passing through the collimating lens 37 into linear light.

In the laser scanning device 30 as structured above, the light emitted from the light source 32 passes through the collimating lens 37, the cylindrical lens 38, the polygon mirror 33*b*, and the f-theta lens 34 in sequence, and is reflected toward the light transmitting member 31*a* by the mirror 36. The light reflected from the mirror 36 is emitted to the outside of the housing 31 through the light transmitting member 31*a*, and is irradiated to the photosensitive body 41 of the developing device 40, thereby forming an electrostatic latent image corresponding to image information on the surface of the photosensitive body 41. The particular structure of the laser scanning device 30 is not limiting; the laser scanning device 30 according to other aspects of the invention may be configured in a different fashion.

The developing device 40 includes the aforesaid photosensitive body 41 on which an electrostatic latent image is formed by the laser scanning device 30, a charge roller 42 to charge the photosensitive body 41, four developing cartridges 43Y, 43M, 43C and 43K, an intermediate transfer belt 44, a first transfer roller 45, and a second transfer roller 46. The four developing cartridges 43Y, 43M, 43C, and 43K develop the electrostatic latent image formed on the photosensitive body 41 into a toner image using toners of yellow, magenta, cyan, and black. Each of the developing cartridges 43Y, 43M, 43C and 43K includes a developing roller 47 to develop the electrostatic latent image formed on the photosensitive body 41 by supplying the toner thereto, and a supply roller 48 to supply the toner to the developing roller 47 by rotating while contacting the developing roller 47. A monochrome image forming apparatus may include just one developing cartridge 43K having black toner. Other colors, and other numbers of colors, may be used in addition to or instead of the exemplary cyan, magenta, yellow, and black colors.

The intermediate transfer belt 44 is supported by support rollers 49*a* and 49*b*, and runs at the same velocity as a rotational linear velocity of the photosensitive body 41. The first transfer roller 45 opposes the photosensitive body 41, and transfers the toner image developed on the photosensitive body 41 onto the intermediate transfer belt 44. The second transfer roller 46 opposes the intermediate transfer belt 44. While the toner image is transferred onto the intermediate transfer belt 44 from the photosensitive body 41, the second transfer roller 46 is spaced apart from the intermediate transfer belt 44. When the toner image is completely transferred onto the intermediate transfer belt 44, the second transfer roller 46 comes into contact with the intermediate transfer belt 44 with a predetermined pressure. The toner image on the intermediate transfer belt 44 is transferred onto the paper while the second transfer roller 46 is in contact with the intermediate transfer belt 44.

The fusing device 50 includes a heating roller 51 having a heat source to heat the toner image-transferred paper and a press roller 52 mounted while opposing the heating roller 51 and maintaining a constant fusing pressure with the heating roller 51. The paper discharge device 60 includes a discharge roller 61 to feed the paper passing through the fusing device 50 to the outside of the main body 10.

The operation of the above-structured image forming apparatus will now be explained briefly. The laser scanning device 30 irradiates light corresponding to yellow image information to the photosensitive body 41 charged with a uniform electric potential by the charge roller 42, and an electrostatic latent image corresponding to the yellow image is formed on the photosensitive body 41. A developing bias is applied to the developing roller 47 of the yellow developing cartridge 43Y, and the yellow toner attaches to the electrostatic latent image to develop the electrostatic latent image into a yellow toner image on the photosensitive body 41. The toner image is transferred onto the intermediate transfer belt 44 by the first transfer roller 45.

When the yellow toner image corresponding to one page is completely transferred, the laser scanning device 30 scans light corresponding to magenta image information to the photosensitive body 41 to form an electrostatic latent image corresponding to the magenta image. The magenta developing cartridge 43M supplies the magenta toner to the electrostatic latent image to develop the electrostatic latent image into a magenta toner image. The magenta toner image formed on the photosensitive body 41 is transferred onto the intermediate transfer belt 44 over the yellow toner image that has already been transferred.

When the toner images of cyan and black are sequentially transferred onto the intermediate transfer belt 44 through the same procedures as above, a color toner image is formed on the intermediate transfer belt 44 by the overlapping toner images of yellow, magenta, cyan and black. The color toner image is transferred onto the paper passing between the intermediate transfer belt 44 and the second transfer roller 46. The image transferred onto the paper is fused to the paper by heat and pressure while passing through the fusing device 50, and the paper having passed through the fusing device 50 is discharged outside by the discharge roller 61.

In the above image forming process, if foreign substances, such as paper dust or toner, are attached to the light transmitting member 31*a* of the laser scanning device 30, the light scanned to the photosensitive body 41 is partially interrupted, and thus an electrostatic latent image cannot be formed properly on the photosensitive body 41, causing deterioration of print quality.

To cope with this problem, the image forming apparatus 100 includes a cleaning device to clean the light transmitting member 31*a* of the laser scanning device 30. As shown in FIGS. 1, 3 and 4, the cleaning device includes a compressed air supply unit 110 to compress air and to supply the compressed air to the light transmitting member 31*a* of the laser scanning device 30. The compressed air supply unit 110 is configured such that the compressed air supply unit 110 can compress air using a force applied to the image forming apparatus 100 by a user without using an additional driving source.

As shown in FIG. 3, the compressed air supply unit 110 includes a cylinder 120 having an air compression part 121 as a space in which air is compressed and a piston 130 mounted in the air compression part 121 of the cylinder 120 to compress air. The cylinder 120 has a cylinder body 122 with air discharge ports 122*a* and an air suction port 122*b*. The air discharge ports 122*a* are provided at one end of the cylinder body 122, and the air suction port 122*b* is arranged adjacent to the air discharge ports 122*a*. Although FIG. 3 shows that the cylinder body 122 is provided with two air discharge ports 122*a* and one air suction port 122*b*, the number of the air discharge ports 122*a* and the air suction port 122*b* can be changed as needed by the design of the image forming apparatus 100.

A shutter 123 is mounted in the air compression part 121 of the cylinder 120 to open and close the air suction port 122*b*. One end of the shutter 123 is fixed to the cylinder body 122, and the shutter 123 pivots on the fixed end to open and close the air suction port 122*b*. When the piston 130 moves in an "A" direction shown in FIG. 3, a suction force is applied to the air suction port 122*b*. The shutter 123 pivots away from the air suction port 122*b* by the suction force, and opens the air suction port 122*b*. On the other hand, when the piston 130 moves in a "B" direction of FIG. 3, the air sucked into the air compression part 121 is compressed. The shutter 123 is pushed against the air suction port 122*b* by an inner pressure of the air compression part 121, and closes the air suction port 122*b*.

The piston 130 has a piston rod 131 having a first end that moves in the air compression part 121 of the cylinder 120 and a second end that extends to the outside of the cylinder 120. The first end portion of the piston rod 131 is provided with a press member 132 to apply a pressure to the air when the piston rod 131 moves. An outer peripheral surface of the press member 132 is in contact with an inner peripheral surface of the cylinder 120 so that the press member 132 can compress the air during the reciprocating movement of the piston rod 131.

As shown in FIG. 4, the cylinder 120 is hingedly coupled to the main body frame 10*a*, and the piston 130 is hingedly coupled to the cover 11. The cylinder 120 has a frame coupling part 124, and the main body frame 10*a* has a first coupling pin 12 fitted through the frame coupling part 124 of the cylinder 120. The cylinder 120 can be hingedly coupled to the main body frame 10*a* by fitting the first coupling pin 12 through the frame coupling part 124 and coupling a fixing member 1, such as a nut, to an end of the first coupling pin 12.

The cover 11 has a piston coupling part 11*a* protruding toward the piston 130. The second end of the piston rod 131 is provided with a cover coupling part 131*a* that is pin-coupled to the piston coupling part 11*a* of the cover 11. The piston 130 can be hingedly coupled to the cover 11 by fitting a second coupling pin 13 through the coupling parts 11*a* and 131*a* and coupling a fixing member 2, such as a nut, to an end of the second coupling pin 13. However, the piston 130 need not be coupled to the cover 11 in all aspects, such as where the piston 130 is driven by hand or by another movable part within the image forming apparatus 100.

As shown in FIGS. 2 and 3, the cleaning device includes at least one connecting pipe 140 to guide the compressed air from the compressed air supply unit 110 to the laser scanning device 30, and a spray member 150 to evenly spray the compressed air supplied from the compressed air supply unit 110 to the light transmitting member 31*a*.

The spray member 150 is mounted adjacent to the light transmitting member 31*a*. The spray member 150 includes a spray hole 151 to spray the compressed air to the light transmitting member 31*a*, and connecting parts 152 to connect to the connecting pipes 140. The connecting parts 152 are arranged along a longitudinal direction of the spray member 150. As shown in FIG. 2, two connecting parts are provided at the spray member 150. The spray hole 151 may be inclined toward the light transmitting member 31*a* and may have a slit shape extending in a longitudinal direction of the light transmitting member 31*a*.

As shown in FIG. 3, the spray member 150 may be provided with a valve member 153 to open and close the spray hole 151. For convenience, the illustration of the valve member is omitted in FIG. 2. A first end of the valve member 153 is fixed to the spray member 150, and a second end of the valve member 153 pivots on the first end to open and close the spray hole 151. When the piston 130 moves in the "A" direction of FIG. 3, a suction force is applied to the spray hole 151. The valve member 153 contacts the spray member 150 by the suction force, and closes the spray hole 151. When the spray hole 151 is closed when air is sucked into the cylinder 120 as described above, the interior of the cylinder 120 can be prevented from being contaminated with paper dust or toner powder sucked into the cylinder 120. On the other hand, when the piston 130 moves in the "B" direction of FIG. 3, the valve member 153 pivots away from the spray hole 151 by an air pressure applied from the cylinder 120 to the spray member 150, and opens the spray hole 151.

One end of the connecting pipe 140 communicates with the air discharge port 122*a* of the cylinder 120. The other end of the connecting pipe 140 is connected to the connecting part 152 of the spray member 150. The connecting pipe 140 may be made of a flexible material. Even when the image forming apparatus 100 has a small inner space, the flexible connecting pipe 140 can be bent so as not to interfere with components of the image forming apparatus 100 arranged between the compressed air supply unit 110 and the laser scanning device 30.

Figure 5:
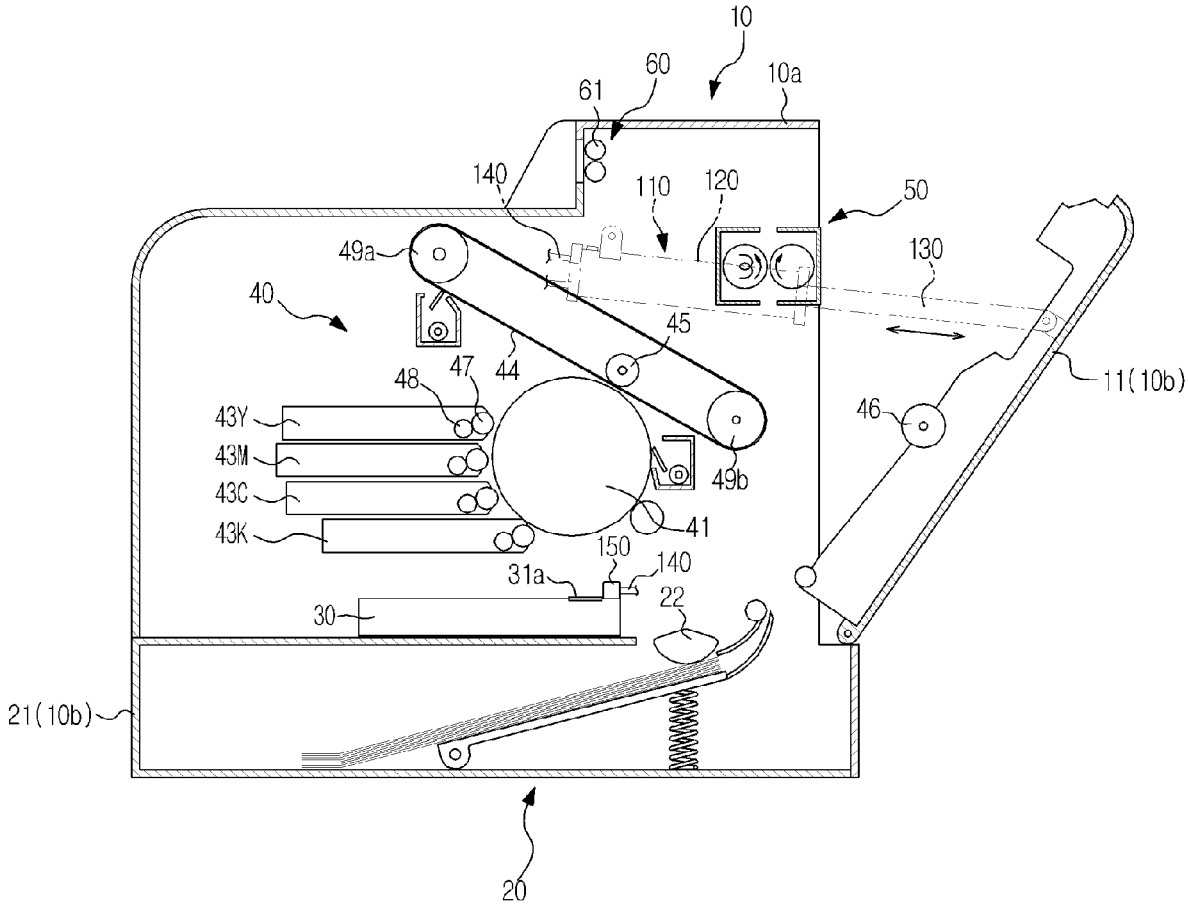
FIG. 5 is a view illustrating a state in which a cover is opened in the image forming apparatus shown in FIG. 1.

The operation of the cleaning device according to an embodiment of the present invention will be described with reference to FIGS. 1, 3 and 5. FIG. 5 shows a state in which the cover is opened in the image forming apparatus shown in FIG. 1. When intending to remove the jammed paper from the image forming apparatus 100 or replace components of the image forming apparatus, such as the developing device 40, the user pulls the cover 11 to open a portion of the main body 10, as shown in FIG. 5. Occasionally, although the image forming apparatus 100 has no error, a user can open the cover 11 to clean the light transmitting member 31*a*.

When the cover 11 moves relative to the main body frame 10*a* as shown in FIG. 5, the piston 130 of the compressed air supply unit 110 coupled to the cover 11 moves in the "A" direction, and accordingly air is sucked into the air compression part 121 of the cylinder 120 through the air suction port 122*b* (refer to FIG. 3). When the user closes the cover 11 as shown in FIG. 1, the piston 130 of the compressed air supply unit 110 moves in the "B" direction, and compresses the air. The compressed air is discharged through the air discharge ports 122*a*, and is guided to the spray member 150 along the connecting pipes 140. The compressed air introduced into the spray member 150 is distributed adequately in the spray member 150, and is sprayed to the light transmitting member 31*a* through the spray hole 151, thereby removing foreign substances attached to the light transmitting member 31*a* (refer to FIG. 3). While not required, a filter can be included at the port 122*b* and/or the ports 122*a* to prevent the introduction of foreign elements by the cleaning member.

Figure 6:
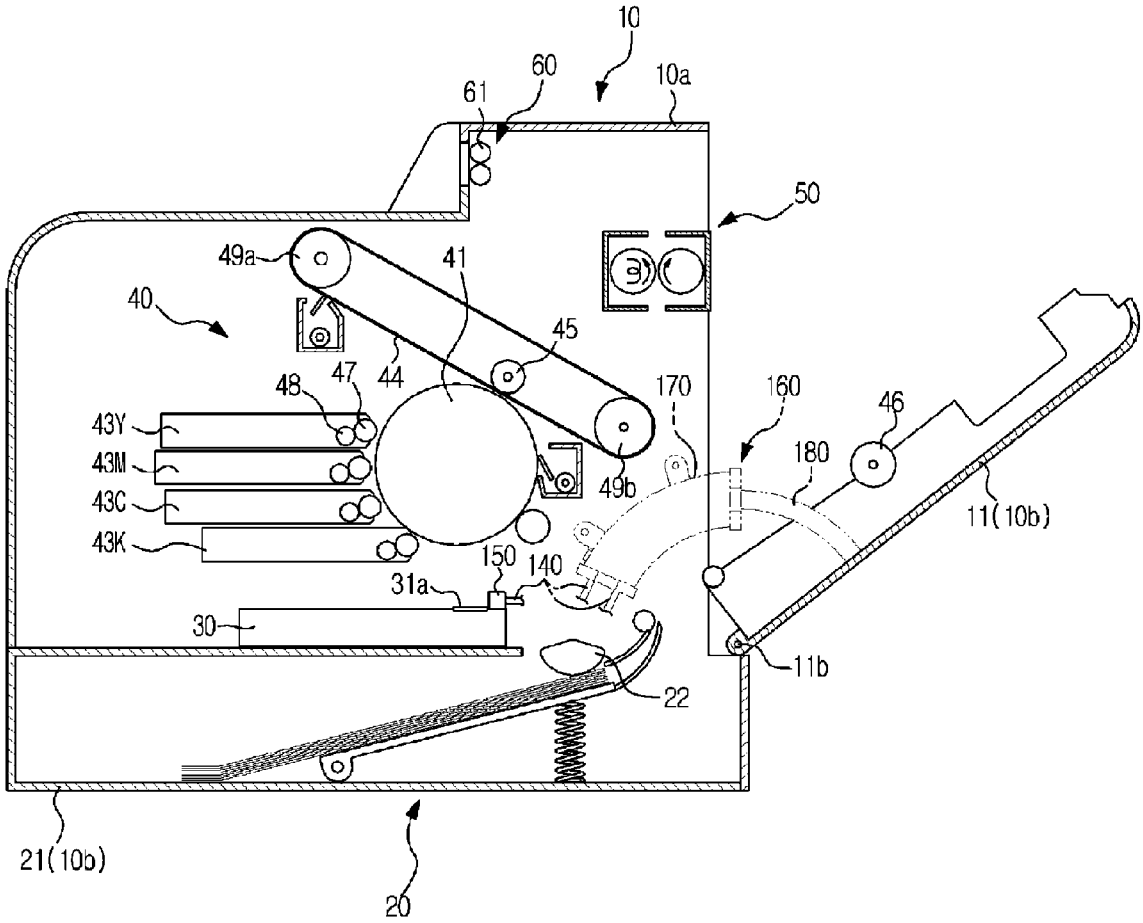
FIG. 6 is a view illustrating a modified example of a mounting position and a structure of a compressed air supply unit in the image forming apparatus according to an embodiment of the present invention.
Figure 7:
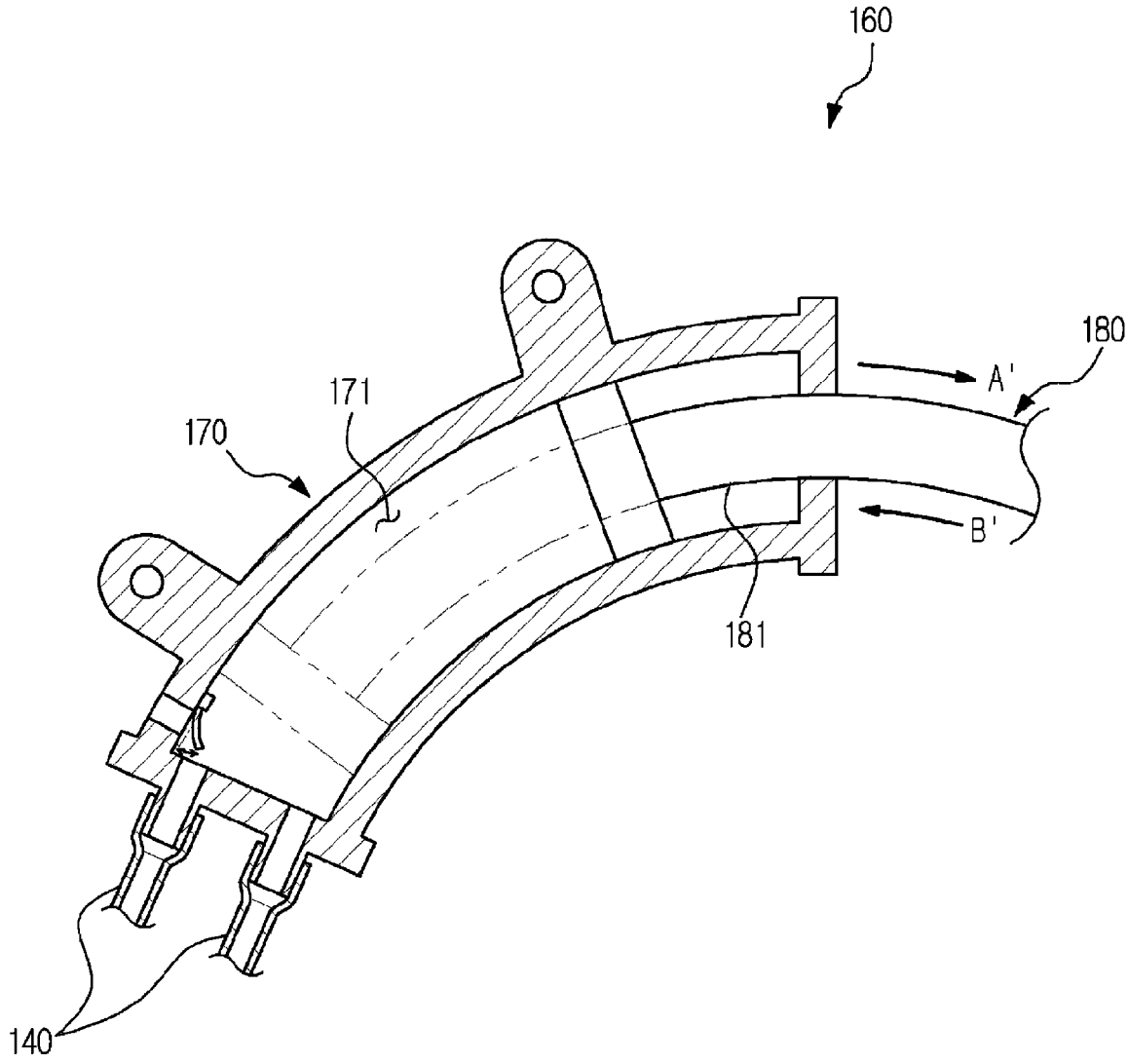
FIG. 7 is a sectional view illustrating a constitution of the compressed air supply unit shown in FIG. 6.

FIG. 6 shows a modified example of the mounting position and structure of the compressed air supply unit in the present invention, according to another embodiment of the present invention. FIG. 7 shows the constitution of the compressed air supply unit shown in FIG. 6.

As shown in FIGS. 6 and 7, a compressed air supply unit 160 according to this embodiment may be mounted near a rotational center 11*b* of the cover 11 and the laser scanning device 30. If the compressed air supply unit 160 is mounted near the rotational center 11*b* of the cover 11, although a pivot angle of the cover 11 is set to be large, the compressed air supply unit 160 can be fabricated compactly. If the compressed air supply unit 160 is mounted near the laser scanning device 30, since the connecting pipes 140 connecting the compressed air supply unit 160 and the laser scanning device 30 can be shortened, the interference of the connecting pipes 140 with the peripheral components can be minimized.

A cylinder 170 of the compressed air supply unit 160 according to this embodiment is fixedly mounted in the main body 10, and an end of a piston 180 is connected to the cover 11. If the end of the piston 180 is fixed to the cover 11, a piston rod 181 may be formed in an arc shape as shown in FIG. 7, based on a rotational trajectory of the cover 11. Accordingly, an air compression part 171 of the cylinder 170, as a space in which the piston rod 181 moves, is also formed in an arc shape corresponding to the piston rod 181.

If the compressed air supply unit 160 is mounted as described above, when the cover 11 is opened, the piston rod 181 moves in an "A" direction of FIG. 7, and air is sucked into the air compression part 171 of the cylinder 170. When the cover 11 is closed, the piston rod 181 moves in a "B" direction of FIG. 7 to compress the air in the air compression part 171, and the compressed air is sprayed to the laser scanning device 30.

Figure 8:
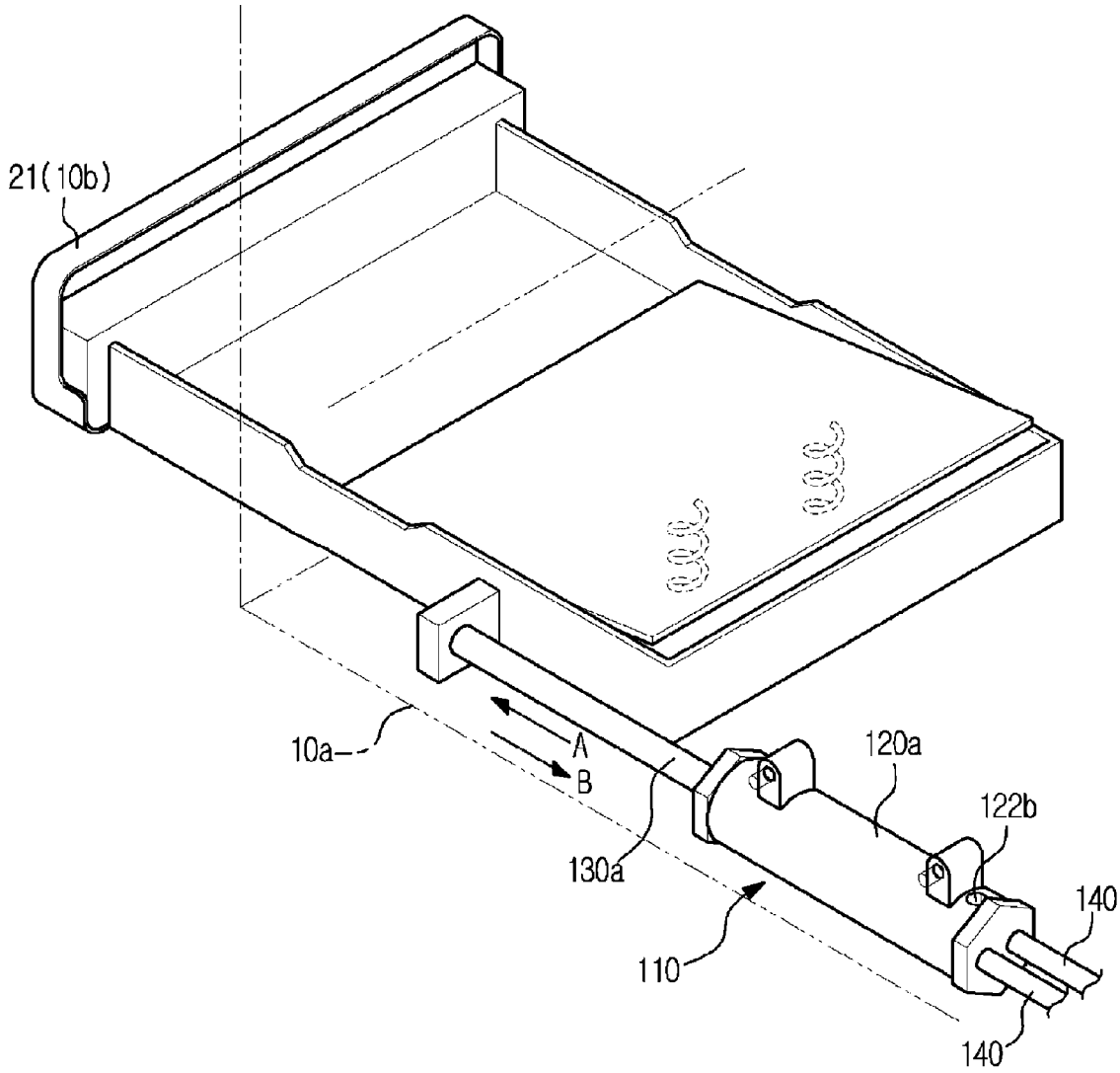
FIG. 8 is a view illustrating a modified example of compressing air by the compressed air supply unit interlocking with components other than the cover.

FIG. 8 shows a modified example of compressing air by the compressed air supply unit interlocking with components other than the cover 11, according to yet another embodiment of the present invention. In the following description, only the structural and operational features of this embodiment are explained, and the same elements as shown in FIGS. 1 to 5 are denoted by the same reference numerals.

A compressed air supply unit 110 of this embodiment is configured such that the compressed air supply unit 110 can compress air by interlocking with the movement of the paper feeding cassette 21 removably mounted to the main body frame 10*a*. As shown in FIG. 8, a piston 130*a* of the compressed air supply unit 110 is fixed to the paper feeding cassette 21, and a cylinder 120*a* is fixed to the main body frame 10*a*. When the user pulls out the paper feeding cassette 21 to insert additional printable media, the piston 130*a* moves with the paper feeding cassette 21 in an "A" direction, and accordingly air is sucked into the cylinder 120*a* through the air suction port 122*b*. When the user pushes in the paper feeding cassette 21, the piston 130*a* moves in a "B" direction and compresses the air in the cylinder 120*a*. The compressed air is discharged through the connecting pipes 140, and cleans the light transmitting member 31*a* (refer to FIG. 3) of the laser scanning device.

In the above description, the light transmitting member 31*a* of the laser scanning device 30 has been exemplified as an object to be cleaned by the cleaning device; however, the present invention is not restricted thereto. Aspects of the present invention can also be applied to cleaning for other objects to be cleaned, such as a roller, in the image forming apparatus.

As apparent from the above description, the image forming apparatus according to aspects of the present invention can clean the inner components of the image forming apparatus by compressing air without an additional driving source.

Further, since the cleaning operation is performed simultaneously when a user removes a paper jam, replaces a component of the image forming apparatus, supplies additional printable media, or accesses the interior of the image forming apparatus for another reason, the user does not need to perform an additional component cleaning operation. Accordingly, convenience in use is enhanced. Still further, the cleaning device according to aspects of the present invention can effectively clean an object to be cleaned without installing complicated structures around the object.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus to form an image onto a printable medium, comprising:

a main body having a main body frame and a moving part that is movable relative to the main body frame;

a laser scanning device; and a compressed air supply unit to compress air by interlocking with movement of the moving part and to supply the compressed air to the laser scanning device so as to clean the laser scanning device, wherein the moving part includes a paper feeding cassette removably mounted to the main body frame.

2. The image forming apparatus according to claim 1, wherein the moving part includes a cover hingedly coupled to the main body frame so as to selectively allow access to an interior of the image forming apparatus.

3. The image forming apparatus according to claim 2, wherein the compressed air supply unit is mounted adjacent to both a rotational center of the cover and a location of the laser scanning device.

4. The image forming apparatus according to claim 1, further comprising:

at least one connecting pipe to guide the compressed air from the compressed air supply unit to the laser scanning device.

5. The image forming apparatus according to claim 4, wherein the at least one connecting pipe is made of a flexible material.

6. The image forming apparatus according to claim 1, wherein:

the laser scanning device includes a light transmitting member; and the image forming apparatus further comprises a spray member mounted near the light transmitting member, the spray member having a spray hole to spray the compressed air supplied from the compressed air supply unit onto the light transmitting member.

7. An image forming apparatus comprising:

a main body having a main body frame and a cover hingedly coupled to the main body frame;

a cylinder including an air compression unit;

a piston having a first end to move in the air compression unit in a reciprocating fashion so as to compress air, and a second end portion coupled to the cover;

an object to be cleaned by the air compressed in the cylinder; and at least one connecting pipe to guide the compressed air to the object to be cleaned.

8. The image forming apparatus according to claim 7, further comprising:

a photosensitive body; and a laser scanning device having a housing provided with a light transmitting member, the laser scanning device scanning light to the photosensitive body through the light transmitting member so as to form an electrostatic latent image onto the photosensitive body;

wherein the object to be cleaned includes the light transmitting member.

9. The image forming apparatus according to claim 7, wherein the piston compresses the air by moving along a rotational trajectory of the cover.

10. The image forming apparatus according to claim 7, wherein:

the piston includes a piston rod having an arc shape; and the air compression part has an arc shape corresponding to the shape of the piston rod.

11. An image forming apparatus comprising:

a main body frame;

a paper feeding cassette removably mounted to the main body frame;

a cylinder fixed to the main body frame;

a piston having a first end arranged to move in the cylinder in a reciprocating fashion so as to compress air and a second end connected to the paper feeding cassette;

an object to be cleaned by the air compressed in the cylinder; and at least one connecting pipe to guide the compressed air to the object to be cleaned.

12. The image forming apparatus according to claim 11, further comprising:

a photosensitive body; and a laser scanning device having a housing provided with a light transmitting member, the laser scanning device scanning light to the photosensitive body through the light transmitting member to form an electrostatic latent image onto the photosensitive body;

wherein the object to be cleaned includes the light transmitting member.

13. A cleaning device to clean a component mounted in an image forming apparatus, comprising:

a connecting portion connectable to a moving part of the image forming apparatus;

a compressed air supply unit having a cylinder and a piston to move in the cylinder in a reciprocating fashion so as to compress air according to a motion of the moving part; and at least one connecting pipe having a first end communicating with the cylinder and a second end extending toward the component to be cleaned.

14. The cleaning device according to claim 13, wherein the at least one connecting pipe is made of a flexible material.

15. The cleaning device according to claim 13, wherein the compressed air supplied from the compressed air supply unit is sprayed to a light transmitting member provided in a laser scanning device of the image forming apparatus.

16. An image forming apparatus comprising:

an image forming unit to form an image onto a printable medium and having at least one component requiring periodic cleaning;

a paper feeding cassette removably mounted to the image forming apparatus to store the printable medium and to supply the printable medium; and a cleaning unit coupled to the paper feeding cassette so as to blow air into the component requiring periodic cleaning by the action of removing and inserting the paper feeding cassette.

17. The image forming apparatus according to claim 16, wherein the component requiring cleaning comprises a laser scanning unit to scan a laser onto a photosensitive body so as to form an electrostatic latent image on the photosensitive body corresponding to the image to be formed onto the printable medium.

18. The image forming apparatus according to claim 16, wherein the cleaning unit comprises:

an air cylinder;

a piston arranged within the air cylinder and having one end coupled to the paper feeding cassette, to move back and forth in a reciprocating fashion so as to blow air into the component requiring cleaning and to suck air out of the component requiring cleaning; and a connecting pipe to connect the air cylinder with the component requiring cleaning to direct the air to the component requiring cleaning.

19. The image forming apparatus according to claim 18, wherein the cleaning unit further comprises:

air discharge ports arranged on one end of the air cylinder to discharge air to the connecting pipe; and suction ports to draw in air to be blown into the component requiring cleaning.

20. An image forming apparatus comprising:

a housing having a cover to open and close so as to selectively allow access to the interior of the image forming apparatus;

an image forming unit having a plurality of components arranged within the housing, at least one of the components requiring periodic cleaning, to form an image onto a printable medium; and a cleaning unit coupled to the cover so as to blow air into the component requiring periodic cleaning by the action of opening and closing the cover, wherein the component requiring cleaning comprises a laser scanning unit to scan a laser onto a photosensitive body so as to form an electrostatic latent image on the photosensitive body corresponding to the image to be formed onto the printable medium.

21. An image forming apparatus comprising:

a housing having a cover to open and close so as to selectively allow access to the interior of the image forming apparatus;

an image forming unit having a plurality of components arranged within the housing, at least one of the components requiring periodic cleaning, to form an image onto a printable medium; and a cleaning unit coupled to the cover so as to blow air into the component requiring periodic cleaning by the action of opening and closing the cover, wherein the cleaning unit comprises an air cylinder;

a piston arranged within the air cylinder and having one end coupled to the cover, to move back and forth in a reciprocating fashion so as to blow air into the component requiring cleaning and to suck air out of the component requiring cleaning; and a connecting pipe to connect the air cylinder with the component requiring cleaning to direct the air to the component requiring cleaning.

22. The image forming apparatus according to claim 21, wherein the cleaning unit further comprises:

air discharge ports arranged on one end of the air cylinder to discharge air to the connecting pipe; and suction ports to draw in air to be blown into the component requiring cleaning.

23. An image forming apparatus to form an image onto a printable medium, comprising:

a main body having a main body frame and a moving part that is movable relative to the main body frame;

a laser scanning device; and a compressed air supply unit to compress air by interlocking with movement of the moving part and to supply the compressed air to the laser scanning device so as to clean the laser scanning device, wherein the compressed air supply unit includes a cylinder coupled to the main body frame; and a piston movably inserted in the cylinder and coupled to the moving part.

24. An image forming apparatus to form an image onto a printable medium, comprising:

a main body having a main body frame and a moving part that is movable relative to the main body frame;

a laser scanning device including a light transmitting member;

a compressed air supply unit to compress air by interlocking with movement of the moving part and to supply the compressed air to the laser scanning device so as to clean the laser scanning device;

a spray member mounted near the light transmitting member, the spray member having a spray hole to spray the compressed air supplied from the compressed air supply unit onto the light transmitting member; and a valve member mounted to the spray member to open and close the spray hole.

* * * * *